United States Patent [19]

Ciccarelli et al.

[11] Patent Number: 4,621,039

[45] Date of Patent: Nov. 4, 1986

[54] DEVELOPER COMPOSITIONS WITH FAST ADMIXING CHARACTERISTICS

[75] Inventors: Roger N. Ciccarelli, Rochester; Denise R. Leon, Fairport, both of N.Y.

[73] Assignee: Xerox Corporation, Stamford, Conn.

[21] Appl. No.: 683,107

[22] Filed: Dec. 18, 1984

[51] Int. Cl.[4] ..... G03G 9/10

[52] U.S. Cl. ..... 430/106; 430/137; 430/110

[58] Field of Search ..... 430/110, 106

[56] References Cited

U.S. PATENT DOCUMENTS

| | | | |
|---|---|---|---|
| 3,320,169 | 5/1967 | East et al. | 430/110 |
| 3,431,412 | 3/1969 | Okubo et al. | 430/110 X |
| 3,874,896 | 4/1975 | Machida et al. | 430/110 X |
| 3,944,493 | 3/1976 | Jadwin et al. | 430/110 X |
| 3,970,571 | 7/1976 | Olson et al. | 430/137 |
| 3,977,983 | 8/1976 | Tsuneda | 430/115 X |
| 4,007,293 | 2/1977 | Mincer et al. | 430/108 X |
| 4,021,358 | 3/1977 | Tomano et al. | 430/109 X |
| 4,246,332 | 1/1981 | Tanaka et al. | 430/109 |
| 4,314,017 | 2/1982 | Takahashi et al. | 430/110 |
| 4,355,167 | 10/1982 | Ciccarelli | 546/255 |
| 4,378,420 | 3/1983 | Gruber et al. | 430/137 X |
| 4,397,934 | 8/1983 | Lu | 430/110 |
| 4,397,935 | 8/1983 | Ciccarelli et al. | 430/110 |

*Primary Examiner*—John D. Welsh

[57] ABSTRACT

An improved toner composition comprised of resin particles, and pigment particles surface treated with charge enhancing additives selected from the group consisting of homopolymers of amine containing monomers, copolymers containing amine monomers, quaternary ammonium salt compounds, polymeric amines, polymeric quaternary ammonium compounds, telomeric amines and telomeric quaternary ammonium salt compositions, and wherein the charge enhancing additives are associated with the pigment particles.

35 Claims, No Drawings

DEVELOPER COMPOSITIONS WITH FAST ADMIXING CHARACTERISTICS

BACKGROUND OF THE INVENTION

This invention is generally directed to toner and developer compositions. More specifically, the present invention relates to toner composition with desirable fast admixing characteristics, and to processes for the preparation thereof. In one embodiment there is provided in accordance with the present invention a toner composition containing therein pigment particles having associated therewith certain charge enhancing additives inclusive of amines and quaternary ammonium salt containing compositions. Additionally, in another embodiment of the present invention there are provided processes for rapidly charging uncharged toner particles wherein there is selected for the charged developer composition toner particles, and incorporated therein pigment particles having associated therewith charge enhancing additives. The developer compositions and processes of the present invention are useful in electrostatographic and particularly xerographic imaging systems. Moreover, several of the developer compositions of the present invention are specifically useful in imaging processes having incorporated therein a Viton coated fuser roll, as these compositions are substantially compatible with such rolls in that they do not react therewith causing undesirable decomposition, and thereby adversely affecting image quality.

Developer compositions with charge enhancing additives, especially additives which impart a positive charge to the toner resin particles, are well known, reference for example U.S. Pat. Nos. 3,893,935; 3,944,493, 4,007,293; 4,079,014 and 4,394,430. Thus, for example, there is described in U.S. Pat. No. 3,893,935 the use of certain quaternary ammonium salts as charge control agents for electrostatic toner compositions. In accordance with the disclosure of this patent, certain quaternary ammonium salts, when incorporated into a toner material, provide a composition which exhibited relatively high uniform stable net toner charge when mixed with a suitable carrier vehicle.

Further, there is disclosed in U.S. Pat. No. 4,338,390 developer and toner compositions having incorporated therein as charge enhancing additives organic sulfate and sulfonate substances. A similar disclosure is present in U.S. Pat. No. 4,394,430.

Moreover, there is disclosed in U.S. Pat. No. 4,298,672 positively charged other compositions with resin particles, and pigment particles, and as a charge enhancing additive, alkyl pyridinium compounds, inclusive of cetyl pyridinium chloride. While the developer compositions disclosed in the '672 patent are sufficient for their intended purposes, it appears that the alkyl pyridinium compounds involved may react with the polymer present on Viton fuser rolls causing decomposition thereof. Also, several other charge control agents disclosed in the prior art interact with Viton fuser rolls used in electrostatographic imaging systems. This interaction causes the fuser roll to be adversely affected resulting in the deterioration of image quality. For example, Viton fuser rolls discolor and turn black, and develop multiple surface cracks and harden when certain charge control additive compounds are present in the toner mixtures. Apparently, these charge enhancing additives are not permanently retained by the toner resin particles, that is, they are leachable therefrom and deposit on the Viton fuser roll causing decomposition thereof. This leaching problem is substantially eliminated with the toner and process of the present invention.

One Viton fuser roll selected for use in electrostatographic copying machines is comprised of a soft roll fabricated from lead oxide and DuPont Viton E-430 resin, a vinylidene fluoride hexafluoropropylene copolymer. This roll contains approximately 15 parts of lead oxide and 100 parts of Viton E-430 which mixture is blended and cured on the roll substrate at elevated temperatures. Apparently, the function of the lead oxide is to control the generation of unsaturation by dehydrofluorination which can cause crosslinking, and to provide release mechanisms for the toner composition. Excellent image quality has been obtained with Viton fuser rolls, however, in some instances there results a toner fuser compatibility problem when charge control agents are part of the toner mixture. For example, as indicated herein, it appears that certain specific charge enhancing additives react with Viton when these additives are not permanently retained on the toner resin particles. In view of this, the Viton fuser roll may turn black, develop multiple surface cracks, and the surface thereof may harden, thereby resulting in image quality deterioration.

Additionally, in order to immediately obtain images of high quality in most xerographic imaging systems upon addition of new uncharged toner particles to the charged developer, it is necessary for these particles to acquire the appropriate charge polarity and charge magnitude. Acquiring this charge can consume a period of in excess of five minutes to about 15 minutes; thus in many instances, initial copies obtained from xerographic imaging apparatuses are of an inferior quality as compared to images obtained thereafter. Once the uncharged developer composition has acquired the appropriate charge, image quality improves. Thus some effort has been directed to providing compositions and processes wherein the uncharged toner particles added to an imaging apparatus will acquire charge of the appropriate magnitude and polarity in a period substantially less than ten minutes. In some instances, no satisfactory images whatsoever can be developed until the uncharged toner is mixed with the charged toner present in the imaging apparatus for a period of from about 10 to 15 minutes mixing time. The period of time within which the uncharged toner acquires the required charge is referred to as admix charging.

There is described in several patents, including U.S. Pat. No. 4,304,830, toner compositions and processes for enabling uncharged toner particles to be charged in a period of from about one minute to about five minutes. According to the teachings of this patent, there is selected for imparting charges to the uncharged toner particles a developer composition containing therein as an important component an alkyl pyridinium charge enhancing additive. Accordingly, when the alkyl pyridinium compound is present, the rate at which the uncharged toner acquires charge, such as a positive charge, is substantially less than ten minutes. Typically, the uncharged toner particles become suitably charged within a period of time of from about one minute to about five minutes, and usually less than about 10 minutes. Such rapid admix charging allows developer systems to be more stable over a shorter priod of time, therefore, better quality images are obtained with no background according to the teachings of this patent.

Therefore, there is a need for improved processes, and improved toner compositions, wherein rapid admix charging can be achieved. There also continues to be a need for toner compositions and processes wherein the charge enhancing additive selected is substantially permanently retained on the toner pigment particles. Also, there is a need for processes that enable uncharged toner particles to acquire a proper charge level and an appropriate polarity in a period of less than about five minutes. Moreover, there remains a need for improved toner compositions that are compatible with fusing rolls incorporated into imaging apparatuses, especially Viton fuser rolls. Further, there remains a need for attaining positively charged toners by simplified methods wherein the pigment particles selected are associated with certain charge enhancing additives. There also remains a need for toner compositions with selected desirable dispersion of pigment particles therein.

SUMMARY OF THE INVENTION

It is an object of the present invention to provide toner compositions and processes which overcome many of the above-noted disadvantages.

In another object of the present invention there are provided positively charged toner compositions with pigment particles having associated therewith certain charge enhancing additives.

In a further object of the present invention there are provided toner compositions, and processes, enabling uncharged toner particles to achieve rapid admixing properties.

In a further object of the present invention there are provided processes wherein uncharged toner particles acquire a positive charge within a period of less than about five minutes.

In yet another object of the present invention there are provided toner compositions with carbon black particles associated with amine and/or quaternary salt-containing substances.

In a further object of the present invention there are provided toner compositions wherein the charge enhancing additive is substantially permanently retained on the toner pigment particles, and wherein the pigment particles are effectively dispersed in the toner resin. Dispersion in this context refers to the location of the pigment particles within the toner matrix so as to enable charge sharing between the toner particles.

In a further object of the present invention there are provided specific toner compositions, and processes which are compatible with Viton fuser rolls.

In yet a further object of the present invention there are provided electrostatic imaging methods wherein the uncharged toner particles selected acquire a charge of the appropriate magnitude and polarity in a period of less than about five minutes.

In another object of the present invention there are provided toner compositions with colored pigment particles associated with amine and/or quaternary salt-containing substances. There compositions are useful in obtaining images of specific colors in xerographic imaging processes.

These and other objects of the present invention are accomplished by providing improved toner compositions and processes of preparation thereof wherein there is selected pigment particles having associated therewith certain charge enhancing additives. More specifically, there is provided in accordance with the present invention positively charged toner compositions comprised of toner resin particles, and pigment particles having associated therewith, including permanent attachment thereto, charge enhancing additives selected from the group consisting of amines, quaternary ammonium compounds, polymeric amines, polymeric quaternary salt compositions, and copolymers containing amine and quaternary salt compositions.

Therefore, in one important embodiment of the present invention there is provided an improved toner composition comprised of resin particles and pigment particles surface treated with charge enhancing additives selected from the group consisting of homopolymers of amine containing monomers, copolymers containing amine monomers, quaternary ammonium salt compounds, polymeric amines, polymeric quaternary ammonium compounds, telomeric amines, and telomeric quaternary ammonium salt compositions wherein the charge enhancing additives are associated with, including permanently attachment thereto, the pigment particles. These toner compositions are positively charged.

Another important embodiment of the present invention resides in an improved positively charged toner composition with rapid admix charging characteristics, a dielectric constant of from about 4 to about 10, and a dielectric loss constant of from about 0.04 to about 1.4; and comprised of resin particles, and carbon black particles surface treated with charge enhancing additives selected from the group consisting of homopolymers of amine containing monomers, copolymers containing amine monomers, quaternary ammonium salt compounds, polymeric amines, polymeric quaternary ammonium compounds, telomeric amines and telomeric quaternary ammonium salt compositions; and wherein the charge enhancing additives are associated with, including permanent attachment, the carbon black particles.

In a further specific embodiment of the present invention there is provided a process for rapidly charging uncharged toner particles with a charged developer composition comprised of toner resin particles, and pigment particles, which charge enhancing additives selected from the group consisting of amines, quaternary ammonium salts, polymeric quaternary salt compositions, and polymeric amines, associated with or adsorbed on the pigment particles, wherein the uncharged toner particles acquire a positive charge within a period of less than about five minutes, and preferably within a period of from about two to about four minutes.

Specifically, there is further provided in accordance with the present invention a process for rapidly charging uncharged toner particles which comprises (1) providing a charged developer composition comprised of toner resin particles, having incorporated therein pigment particles, and a charge enhancing additive associated therewith; and (2) contacting uncharged toner particles containing resin particles, and pigment particles having associated therewith a charge enhancing additive, wherein the uncharged toner particles acquire a positive charge of an appropriate polarity and magnitude within a mixing period of from about less than 5 minutes, which charge is from about 10 microcoulombs per gram to about 30 microcoulombs per gram.

Illustrative examples of suitable toner resins selected for the toner and developer compositions of the present invention include polyamides, epoxies, diolefins, polyurethanes, vinyl resins and polymeric esterification products of a dicarboxylic acid and a diol comprising a diphenol. Any suitable vinyl resin may be selected for the toner resins of the present application including homopolymers or copolymers of two or more vinyl monomers. Typical of such vinyl monomeric units are: styrene, p-chlorostyrene, unsaturated mono-olefins such as ethylene, propylene, butylene, isobutylene and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and other similar acrylates; acrylonitrile, methacrylonitrile, acrylimide, vinyl ethers, such as vinyl methyl ether, vinyl isobutyl ether, vinyl ethyl ether, and the like; vinyl ketones such as vinyl methyl ketone, vinyl hexyl ketone, and methyl isopropenyl ketone; and N-vinyl indole, N-vinyl pyrrolidene and the like; styrene butadiene copolymers, and mixtures thereof.

As preferred toner resins there can be selected styrene polymers and the esterification products of a dicarboxylic acid and a diol comprising a diphenol. The aforementioned polyesters are illustrated in U.S. Pat. No. 3,590,000, the disclosure of which is totally incorporated herein by reference. Other specific preferred toner resins include styrene/methacrylate copolymers, styrene/butadiene copolymers, polyester resins obtained from the reaction of bis-phenol A and propylene oxide, followed by the reaction of the resulting product with fumaric acid, branched polyester resins resulting from the reaction of dimethylterephthalate, 1,3-butanediol, 1,2-propanediol, and pentaerythritol; styrene butadiene copolymers prepared by a suspension polymerization process, reference U.S. Ser. No. 453,252, filed Dec. 27, 1982, the disclosure of which is totally incorporated herein by reference; styrene butadiene resins prepared by an emulsion polymerization process, reference U.S. Ser. No. 453,253, the disclosure of which is totally incorporated herein by reference; and Pliolites.

Numerous well known suitable pigments or dyes can be selected as the colorant for the toner particles including, for example, carbon black, nigrosine dye, aniline blue, magnetites and mixtures thereof. The pigment, which is preferably carbon black, should be present in a sufficient amount to render the toner composition highly colored thus enabling the formation of a clearly visible image on a suitable recording member. Generally, the pigment particles are present in amounts of from about 3 percent by weight to about 20 percent by weight based on the total weight of the toner composition, however, lesser or greater amounts of pigment particles can be selected providing the objectives of the present invention are achieved. The aforementioned toner compositions, wherein the carbon black particles have associated therewith the charge enhancing additive disclosed herein, possess rapid admix charging characteristics, and desirable dispersion of the carbon black particles in the toner resin, reference a dielectric constant for this composition of from about 4 to about 10; and a dielectric loss constant of from about 0.04 to about 1.4.

The pigment particles can also be selected from cyan, magenta, yellow, blue, red, green, and other similar colored pigments, or mixtures thereof, enabling the formation of colored developer compositions. These pigments are generally present in the toner compositions in an amount of from about 2 percent by weight to about 30 percent by weight. Illustrative examples of cyan, magenta and yellow pigments that can be selected include, for example, 2,9-dimethyl-substituted quinacridone and anthraquinone dye identified in the color index as Cl 60710, Cl Dispersed Red 15, a diazo dye identified in the color index as Cl 26050, Cl Solvent Red 19, and the like. Illustrative examples of cyan materials that may be used as pigments include copper tetra-4(octadecyl sulfonamido) phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl dispersed yellow 33, 2,5-dimethoxy-4-sulfonanilide phenylazo-4'-chloro-2,5-dimethoxy aceto-acetanilide, permanent yellow FGL, and other similar compositions.

Illustrative examples of charge enhancing additives selected for the present invention include (1) homopolymers of amine containing monomers such as 2-vinylpyridine, 3-vinylpyridine, 4-vinylpyridine, N,N-dimethylamino ethylmethacrylate, N-tertiary-butylaminoethylmethacrylate, and similar other mono and dialkyl aminoethylmethacrylates and acrylates; (2) copolymers containing the above amino monomer wherein the comonomer may be selected from any suitable monomers such as styrenes, acrylates, methacrylates, butadienes, and the like, including styrene 2-vinylpyridine copolymer, n-butylmethacrylate 2-vinylpyridine copolymer; and partial or complete quaternary ammonium salts of these homopolymer of amines, and copolymers, such as 4-vinyl-n-butylpyridinium bromide, 4-vinylpyridine-4-vinyl-n-butylpyridinium bromide copolymer (90/10), and 2-vinylpyridine/2-vinyl-n-butylpyridinium bromide copolymer (90/10). Other charge enhancing additives that may be selected for treatment of the pigment particles include those polymeric quaternary salts of the formula $[A_XB_Y]_Z$, wherein A is a segment selected from vinyl monomers, B is a quaternary salt segment, X and Y are numbers representing mole fractions of A and B, the sum of X and Y being equal to 1, and Z represents the degree of polymerization, reference U.S. Pat. No. 4,355,167, the disclosure of which is totally incorporated herein by reference. Also, useful charge enhancing additives that can be selected are the polymeric amines as described in U.S. Pat. No. 4,371,601, the disclosure of which is totally incorporated herein by reference.

In an essential feature of the present invention, the charge enhancing additives illustrated herein are associated with the pigment particles. Association is affected by appropriately mixing the pigment particles and charge enhancing additives prior to adding the resulting mixture to the polymer resin particles required for formation of the toner composition. Accordingly, thus rather than mixing the polymer resin particles and pigment particles in the usual manner which prevents the charge enhancing additives from associating with, inclusive of permanent attachment of the pigment particles surface, in the present invention the charge enhancing additives and pigment particles are initially mixed;

and subsequently this mixture is added to the polymer resin particles, or alternatively the polymer resin particles may be added to the mixture of pigment particles and charge enhancing additives. More specifically, thus pigment particles such as carbon black are contacted with the charge enhancing species dissolved in a suitable solvent, and subsequent to mixing the solvent is removed from the mixture. There results a dry powder with the charge enhancing additive associated with, and/or permanently attached to the carbon black particles.

With further reference to the toner compositions of the present invention, the charge enhancing additive is present as a continuous coating on the entire outer surface of the pigment particles. The amount of charge enhancing additive present depends on a number of factors including the specific pigment selected, that is for example, whether it is of a high surface area or low surface area, whether it is oxidized or unoxidized, the solvent used for dissolving the charge enhancing additive, and the toner polymer selected. Generally, however, the charge enhancing amount is from about 2 percent by weight to about 30 percent by weight. Permanent attachment and/or association of the charge enhancing additives with the pigment particles can be established by a number of known procedures including, for example, continuously extracting the treated pigment particles with the solvent selected for affecting dissolution of the charge enhancing additive, followed by elemental analysis for nitrogen, an essential species present in the charge enhancing additive compounds. Additionally, that the entire surface of the pigment particles are associated, and/or permanently attached with the charge enhancing additives, can be determined by reacting halide ion containing charge enhancing additives with silver ion; and subsequently identifying the location of the silver by electron microscopy.

The charge enhancing additives associated with the pigment particles are generally adsorbed on the entire surface thereof. When mixing with the pigment particles, the charge enhancing additives are added thereto in an amount of from about 2 percent by weight to about 30 percent by weight, and mixing is affected as indicated herein for sufficient periods of time and with a suitable solvent enabling the complete coating of the pigment particles with the charge enhancing additive compounds. Since the charge enhancing additives are associated with the pigment particles, they are not available for contaminating other machine components including Viton fuser rolls. Additionally, the surface treatment of carbon black particles enables rapid admixing times for uncharged toner particles added thereto. Examples of suitable solvents that can be selected for accomplishing the association of the charge enhancing additives with the pigment particles include halogenated aliphatic compositions, such as chloroform, methylene chloride, and the like. Various aromatic solvents may also be useful providing the objectives of the present invention are achieved. These solvents are used in an amount that will affect the dissolving of the charge enhancing additives inclusive of, for example, from about 10 milliliters to about 500 milliliters.

A typical positive charge intensity for the toner compositions of the present invention is from about 10 microcoulombs per gram to about 50 microcoulombs per gram, and preferably from about 10 microcoulombs per gram to about 30 microcoulombs per gram. Also, in accordance with the improved process of the present invention, new uncharged toner particles added as a replenishment material to a positively charged developer composition comprised of toner particles and carrier particles are rapidly charged when there is incorporated into the toner composition pigment particles having associated therewith and/or permanently adsorbed on the surface the charge enhancing additives indicated. This is known, as indicated hereinbefore, as rapid admix charging. By admix charging in accordance with the present invention is meant providing the appropriate positive charges at a rapid rate to new uncharged replenishment toner particles being added to a developer composition comprised of toner and carrier particles. The admix charging characterisitcs can be determined by a number of suitable methods, however, one preferred method selected for this purpose is the known charge spectograph. Thus, the amount of charge acquired and the time within which it is acquired is measured by the toner charge spectrograph. This instrument disperses toner particles in proportion to their charge/diameter, and with the aid of an automated microscopy can generate charge distribution histograms or curves for selected toner size classes. Use of the spectrograph thus allows the monitoring of the admixed toner charging rates. Should the admix rates be too slow, the uncharged toner will form a second peak in the distribution curves. Charge distribution time sequences can thus be used to distinguish between slow and rapid admix charging rates, reference U.S. Pat. No. 4,378,420, the disclosure of which is totally incorporated herein by reference. While it is not desired to be limited by theory, it is believed that the toner and process design of the present invention wherein the carbon black particles have associated therewith the charge enhancing additive enables the rapid admix charging characterisitcs, caused by charge sharing. Therefore, it is critical with respect to achieving rapid admix characteristics that the charge enhancing additives are associated with or attached to the carbon black particles, and that these particles are appropriately dispersed in the polymeric resin particles. Without proper dispersion, charge sharing between the carbon black particles, one essential feature of the present invention does not result.

Illustrative examples of carrier particles that can be selected for mixing with the toner of the present invention include those particles that are capable of triboelectrically obtaining a charge of opposite polarity to that of the toner particles. Accordingly, the carrier particles of the present invention are selected so as to be of a negative polarity, allowing the toner particles which are positively charged to adhere to and surround the carrier particles. Illustrative examples of such carrier particles include methyl methacrylate, glass, steel, nickel, iron ferrites, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. The selected carrier particles can be used with or without a coating, the coating generally being comprised of fluoropolymers, such as polyvinylidenefluoride resins, terpolymers of styrene, methylmethacrylate, and a silane, such as vinyl triethoxy silane, tetrafluoroethylenes, copolymers available as FP 461, other known coatings, and the like.

While the diameter of the carrier particles can vary, generally it is from about 50 microns to about 1,000 microns, thus allowing these particles to possess sufficient density and inertia to avoid adherence to the electrostatic images during the development process. The carrier particles can be mixed with the toner composition in various suitable combinations, however, best results are obtained when about 1 part to about 10 parts toner to about 200 parts by weight of carrier are mixed.

The toner compositions of the present invention can be prepared by a number of known methods including melt blending the toner resin particles containing the pigment particles associated with the charge enhancing additives illustrated herein, followed by mechanical attrition. Other methods include those well known in the art such as spray drying, melt dispersion, dispersion polymerization, suspension polymerizations, and extrusion processes. Toner compositions prepared in this manner result in a positively charged composition in relation to the carrier materials selected. As illustrated hereinbefore, it is critical to the composition and process of the present invention that the pigment particles and charge enhancing additives be separately mixed enabling the attachment of the charge enhancing additives thereto, followed by the addition of this mixture to the polymer resin, or alternatively the polymer resin can be added to the mixture of charge enhancing additive and pigment particles. In prior art preparation sequences the charge enhancing additive, pigment particles and polymer resin particles are mixed together, which causes the charge enhancing additive to be present throughout the polymeric resin rather than associated with, and/or permanently attached to the pigment particles. This prevents charge sharing from occurring, and thus rapid admixing is not achievable. One present solution to this problem is to mix the three components in a manner that the charge enhancing additive is situated between the pigment particles and toner resin particles, however, this process requires carefully controlled process equipment, for example.

The toner and developer compositions of the present invention may be selected for use in developing images in electrostatographic imaging systems, containing therein conventional photoreceptors providing that they are capable of being charged negatively. This usually occurs with organic photoreceptors illustrative examples of which include layered photoresponsive devices comprised of transport layers and photogenerating layers, reference U.S. Pat. No. 4,265,990, the disclosure of which is totally incorporated herein by reference. Examples of generating layers include trigonal selenium, metal phthalocyanines, metal free phthalocyanines, squaraine pigments and vanadyl phthalocyanines, while examples of charge transport layers include the aryl amines as disclosed in U.S. Pat. No. 4,265,990. Other photoresponsive devices useful in the present invention include polyvinylcarbazole, 4-dimethylaminobenzylidene, benzhydrazide; 2-benzylidene-amino-carbazole, 4-dimethaminobenzylidene, (2-nitrobenzylidene)-p-bromoaniline; 2,4-diphenyl-quinazoline; 1,2,4-triazine; 1,5-diphenyl-3-methyl pyrazoline, 2-(4'-dimethyl-amino phenyl)benzoaxzole; 3-amino-carbazole, polyvinyl carbazole-trinitrofluorenone charge transfer complex; and mixtures thereof.

There is also envisioned, in accordance with the present invention, the development of electrostatic latent images which comprises causing the formation of an electrostatic latent image on an image-bearing member, developing the image with the composition of the present invention comprised of toner resin particles containing therein pigment particles having associated therewith charge enhancing additives, which compositions may have added thereto uncharged replenishment toner particles, and wherein the uncharged replenishment toner particles are charged to the appropriate polarity and magnitude by contacting these particles with the charged toner particles causing the uncharged toner particles to acquire a charge within a period of from about five seconds to about five minutes thereby resulting in the same level of charge intensity for the toner particles initially contained in the charge developer composition and the uncharged replenishment toner particles, this charge intensity being from about 5 microcoulombs per gram to about 50 microcoulombs per gram, followed by transferring the image to a suitable substrate, and permanently affixing the image thereto.

The following examples are being supplied to further define various species of the present invention, it being noted that these examples are intended to illustrate and not to limit the scope of the present invention. Parts and percentages are by weight unless otherwise indicated.

EXAMPLE I

There were initially prepared carbon black particles treated with a charge enhancing additive by placing in a 250 milliliter bottle, 25 milliliters of ¼ inch stainless steel balls, 15 grams of BP 1300 carbon black, and 50 milliliters of chloroform. Thereafter, the mixture was roll milled for 6 hours, and there was added thereto a solution of poly(2-vinylpyridine), 2.7 grams, in 50 milliliters of chloroform. Further roll mixing was accomplished for 14 hours, and thereafter the steel balls were removed from the mixture, followed by evaporation of the chloroform. There were isolated carbon black particles having permanently attached to the entire surface the charge enhancing additive poly(2-vinylpyridine).

For the purpose of establishing that the charge enhancing additive poly(2-vinylpyridine) was permanently attached to the carbon black particles, the above-prepared product was extracted several times with the solvent chloroform, 50 milliliters of solvent being used for each extraction, and thereafter elemental analysis indicated 1.93 percent nitrogen, which is equivalent to about 15 percent charge enhancing additive being coated on the carbon black.

A toner composition was then prepared by melt blending followed by mechanical attrition, jetting to a particular size diameter of 12 microns, followed by classification, by adding 83.55 percent by weight of a styrene n-butyl methacrylate copolymer, 65 percent by weight of styrene, and 35 percent by weight of n-butyl methacrylate, and about 16.45 percent by weight of the treated carbon black particles prepared in accordance with the above procedure. The treated carbon black particles are added in an amount so as to enable a final toner composition product with 14 percent by weight of carbon black.

A developer composition was then prepared at 1.5 percent toner concentration by mixing the above prepared toner with a carrier consisting of nuclear metals, coated with a chlorofluorinated polymer available as FPC 461. The toner composition had a triboelectric charge thereon of 25 microcoulombs per gram, and further the admix charging time was 15 seconds. The triboelectric charging values and admix times were determined in all instances with a charge spectrograph. This data indictes that when a freshly uncharged developer composition comprised of carbon black particles, the styrene n-butyl methacrylate copolymer particles, and the charge enhancing additive poly(2-vinylpyridine) permanently attached to the carbon particles, are added to a charged developer composition with the same components, the admix charging rate for the uncharged toner composition was less than 15 seconds.

In contrast, the admixing time, as determined on the same charge spectrograph, was greater than 10 minutes for a toner composition prepared in substantially a similar manner with the exception that the charge enhancing additive, polymer particles and pigment particles were melt blended and mixed in one container, wherein there results a composition with no permanent attachment of the charge enhancing additive to the pigment particles.

The surface treated carbon black particles were appropriately dispersed in the polymer particles in that there resulted charge sharing between two different toner particles. More specifically, the desirable dispersion is evidenced by dielectric measurements and optical microscopy evaluation of solvent swollen toner. Therefore, dispersion evaluation of the above prepared toner composition with surface treated carbon black polymers was determined by affecting solvent swelling thereof followed by optical microscopy, and further by determining the dielectric properties with K′ representing the dielectric constant which was about 7.49, and K″ representing the dielectric loss which was about 0.794.

The above prepared developer composition can be selected for developing images in a xerographic imaging device, with a layered photoreceptor comprised of a Mylar substrate, overcoated with a photogenerating layer of trigonal selenium, dispersed in a polyvinyl carbazole binder, and as top layer in contact with the photogenerating layer, the charge transport molecules N,N′-diphenyl-N,N′-bis(3-methylphenyl)1,1′-diphenyl-4,4′-diamine, dispersed in a polycarbonate resin commercially available as Markrolon, which device is prepared in accordance with the disclosure of U.S. Pat. No. 4,265,990.

The device selected may also contain a Viton fuser roll. No damage will occur to the Viton fuser roll, that is, the Viton should not turn black, crack, or harden; but rather will remain smooth and soft. Furthermore, when an uncharged replenishment toner composition containing styrene n-butyl methacrylate and carbon black particles, having permanently attached thereto the charge enhancing additive poly(2-vinylpyridine), is added to the charge developer mixture in the imaging apparatus, the replenishment particles can acquire a positive polarity of 25 microcoulombs per gram in a period of less than 15 seconds indicating rapid admix.

EXAMPLE II

A number of toner and developer compositions were prepared by repeating the procedure of Example I with the exception that other carbon black pigment particles were selected, and in some instances different charge enhancing additives. The triboelectric charging values, admix characteristics, and dispersability for each of these compositions was determined in accordance with the procedure as outlined in Example I. Moreover, each of the carbon treated black pigments prepared were solvent extracted, followed by elemental analysis in order to establish that the charge enhancing additive was permanently attached thereto.

The following table indicates the specific components selected for affecting preparation of the toner compositions, elemental analysis for nitrogen, the triboelectric charging value, and the admix charging time.

TABLE I

| Carbon Black Component | % N | Triboelectric Charge In Microcoulombs Per Gram | Admix Time (Sec.) | Dielectric Constant K′ | Dielectric Loss K″ |
|---|---|---|---|---|---|
| CSX 99 (Cabot) poly(2-vinyl pyridine) | 1.02 | 16 | 15 | 7.63 | 0.495 |
| Black Pearls 1300 poly(2-vinyl pyridine) | 1.93 | 27 | 15 | 7.49 | 0.794 |
| CSX 99 (Cabot) poly(4-vinyl pyridine) | 1.50 | 15 | 15 | 9.97 | 1.37 |
| CSX 99 (Cabot) amino acrylate* | 0.53 | 17 | 15 | 7.24 | 0.483 |
| Black Pearls 1300 amino acrylate | 1.31 | 30 | 30 | 4.63 | 0.083 |

*poly N,N′—dimethyl amino ethyl methacrylate

Also, the poly(2-vinylpyridine) charge enhancing additive selected had a number average molecular weight of 35,000, and a weight average molecular weight of 77,440; the poly(4-vinylpyridine) had a number average molecular weight of 41,700 and a weight average molecular weight of 85,800; and the dimethylaminoethyl methacrylate charge enhancing additive had a number average molecular weight of 4,080 and a weight average molecular weight of 21,200.

Other modifications of the present invention may occur to those skilled in the art based upon a reading of the present disclosure, and these modifications are intended to be included within the scope of the present invention.

We claim:

1. An improved toner composition comprised of resin particles, and pigment particles surface treated with charge enhancing additives the additive being present as a continuous coating on the outer surface of the pigment particles, and being selected from the group consisting of homopolymers of amine containing monomers, copolymers containing amine monomers, quaternary ammonium salt compounds, polymeric amines, polymeric quaternary ammonium compounds, telomeric amines and telomeric quaternary ammonium salt compositions, and wherein the charge enhancing additives are associated with the pigment particles.

2. An improved toner composition in accordance with claim 1, wherein the charge enhancing additive is permanently attached to the entire surface of the pigment particles.

3. An improved toner composition in accordance with claim 1, wherein the charge enhancing additive is poly(2-vinylpyridine).

4. An improved toner composition in accordance with claim 1, wherein the charge enhancing additive is poly(4-vinylpyridine).

5. An improved toner composition in accordance with claim 1, wherein the charge enhancing additive is poly N,N-dimethyl amino ethyl methacrylate.

6. An improved toner composition in accordance with claim 1, wherein the pigment particles are selected from the group consisting of magenta, cyan, yellow, red, blue, green and mixtures thereof.

7. An improved toner composition in accordance with claim 1, wherein the pigment particles are carbon black.

8. An improved toner composition in accordance with claim 1, wherein the resin particles are selected from the group consisting of styrene acrylate copolymers, styrene methacrylate copolymers, styrene butadiene copolymers, and polyesters.

9. An improved toner composition in accordance with claim 1, wherein carbon black is the pigment, and the dielectric constant K′ is from about 4 to about 10.

10. An improved toner composition in accordance with claim 1, wherein carbon black is the pigment, and the dielectric loss constant K″ is from about 0.04 to about 10.

11. A developer composition comprised of the toner composition of claim 1 and carrier particles.

12. A developer composition in accordance with claim 11, wherein the carrier particles consist of a steel core coated with a polymeric composition.

13. A developer composition in accordance with claim 11, wherein the charge enhancing additive is selected from the group consisting of poly(2-vinylpyridine), poly(4-vinylpyridine), and poly N,N-dimethyl amino ethyl methacrylate.

14. A developer composition in accordance with claim 11, wherein the pigment particles are carbon black.

15. A developer composition in accordance with claim 11, wherein the pigment particles are carbon black with a surface area of from about 95 to about 1,000 meter$^2$/gram.

16.. A developer composition in accordance with claim 11, wherein the pigment particles are cyan, magenta, yellow, red, blue, green or mixtures thereof.

17. A developer composition in accordance with claim 11, wherein the resin particles are selected from styrene acrylate copolymers, styrene methacrylate copolymers, styrene butadiene copolymers, or polyesters.

18. A process for rapidly charging uncharged toner particles which comprises (1) providing a charged developer composition comprised of toner resin particles having incorporated therein carbon black particles, and a charge enhancing additive associated therewith, and (2) contacting uncharged toner particles containing resin particles, and pigment particles having associated therewith a charge enhancing additive, wherein the uncharged toner particles acquire a positive charge of an appropriate polarity and magnitude within a mixing period of from about less than 5 minutes, which charge is formed about 10 microcoulombs per gram to about 30 microcoulombs per gram.

19. A process in accordance with claim 18, wherein the uncharged toner particles acquire a charge of 10 microcoulombs per gram to about 40 microcoulombs per gram in from about two to about four minutes.

20. A process in accordance with claim 18, wherein the charge enhancing additive is selected from the group consisting of poly(2-vinylpyridine), poly(4-vinylpyridine) and poly N,N-dimethyl amino ethyl methacrylate.

21. A process in accordance with claim 18, wherein the resin particles are selected from the group consisting of styrene acrylate copolymers, styrene methacrylate copolymers, styrene butadiene copolymers, and polyesters.

22. A process for affecting development of electrostatic latent images which comprises generating an image on a photoconductive member, contacting the image with the toner composition of claim 1, followed by transferring the image to a suitable substrate, and optionally permanently affixing the image thereto.

23. A method of imaging in accordance with claim 22, wherein fixing is affected with a soft fuser roll.

24. A method of imaging in accordance with claim 22, wherein the toner composition is comprised of carbon black particles having permanently attached thereto a charge enhancing additive selected from the group consisting of poly(2-vinylpyridine), poly(4-vinylpyridine) and poly N,N-dimethyl amino ethyl methacrylate.

25. A method of imaging in accordance with claim 22, wherein the imaging member is comprised of a supporting substrate, a photogenerating layer, and an amine transport layer.

26. A method of imaging in accordance with claim 25, wherein the photogenerating layer is selected from metal phthalocyanines, metal free phthalocyanines, vanadyl phthalocyanines, or trigonal selenium.

27. A process for the preparation of toner particles with rapid admix characteristics, a dielectric constant K′ of from about 4.0 to 10, a dielectric loss constant K″ of from about 0.04 to about 1.4, which comprises (1) admixing carbon black particles and dissolved in a solvent charge enhancing additive particles, (2) continually mixing enabling the charge enhancing additive partices to become permanently attached to the carbon black particles, (3) removing the solvent from the mixture, (4) subsequently adding toner resin particles thereto, and (5) mixing the toner resin particles and the surface treated pigment particles.

28. A process in accordance with claim 27, wherein the charge enhancing additive is selected from the group consisting of poly(2-vinylpyridine), poly(4-vinylpyridine), and poly N,N-dimethyl amino ethyl methacrylate.

29. A process in accordance with claim 27, wherein the resin particles are selected from styrene acrylate copolymers, styrene methacrylate copolymers, styrene butadiene copolymers, and polyesters.

30. An improved toner composition with rapid admix charging chacteristics, a dielectric constant of from about 4 to about 10, and dielectric loss constant of from about 0.04 to about 1.4, comprised of resin particles, and carbon black particles surface treated with charge enhancing additives the additive being present as a continuous coating on the outer surface of the pigment particles, and being selected from the group consisting of homopolymers of amine containing monomers, copolymers containing amine monomers, quaternary ammonium salt compounds, polymeric amines, polymeric quaternary ammonium compounds, telomeric amines and telomeric quaternary ammonium salt compositions, and wherein the charge enhancing additives are associated with the carbon black particles.

31. An improved toner composition in accordance with claim 30, wherein the charge enhancing additive is selected from the group consisting of poly(2-vinylpyridine), poly(4-vinylpyridine) and poly N,N-dimethyl amino ethyl methacrylate.

32. A developer composition in accordance with claim 14, wherein the toner composition has a dielectric constant of from 4 to about 10, and a dielectric loss constant of from 0.04 to about 1.4.

33. An improved toner composition consisting essentially of resin particles, and pigment particles with a continuous coating thereover of a charge enhancing additive selected from the group consisting of homopolymers of amine containing monomers, copolymers containing amine monomers, quaternary ammonium salt compounds, polymeric amines, polymeric quaternary ammonium compounds, telomeric amines and telomeric quaternary ammonium salt compositions.

34. A toner composition in accordance with claim 33, wherein the charge enhancing additive is selected from the group consisting of poly(2-vinylpyridine), poly(4-vinylpyridine), and poly N,N-dimethyl amino ethyl methacrylate.

35. A toner composition in accordance with claim 1, wherein the pigments are selected from the group consisting of magenta, cyan, yellow, red, blue, green and mixtures thereof; and carbon black.

* * * * *